US005309579A

United States Patent [19]

Nelson

[11] Patent Number: 5,309,579

[45] Date of Patent: May 10, 1994

[54] ADJUSTABLE TRIM PLATE FOR TOILET REPLACEMENT

[76] Inventor: Matthew M. Nelson, 217 Norfolk St., Dorchester, Mass. 02124

[21] Appl. No.: 103,273

[22] Filed: Aug. 6, 1993

[51] Int. Cl.[5] ..... E03D 11/00

[52] U.S. Cl. ..... 4/252.1; 4/252.3; 285/56; 285/58; 285/46; 285/42

[58] Field of Search ..... 4/252.1-252.6, 4/253, 661; 285/56, 57, 58, 59, 60, 93, 46, 42, 43, 44, 24; 52/199, 219, 60; 411/539, 546

[56] References Cited

U.S. PATENT DOCUMENTS

| | | | |
|---|---|---|---|
| Re. 24,492 | 6/1958 | Gordon | 4/252.3 |
| D. 255,481 | 6/1980 | Moore | 4/252.1 |
| 712,022 | 10/1902 | Underhill . | |
| 1,521,645 | 1/1925 | Penovi . | |
| 2,229,814 | 1/1941 | Mikolajczak | 4/252 |
| 2,743,460 | 5/1956 | Youngstrom . | |
| 2,758,316 | 8/1956 | Schwarz et al. | 4/252 |
| 2,800,850 | 7/1957 | McKann | 285/44 |
| 3,457,571 | 7/1969 | Harbeke | 4/253 |
| 4,570,396 | 2/1986 | Struben | 52/90 |
| 4,886,302 | 12/1989 | Forbes | 285/56 |
| 4,937,991 | 7/1990 | Orth | 285/42 |
| 5,246,255 | 9/1993 | Forbes et al. | 285/56 |

FOREIGN PATENT DOCUMENTS

| | | | |
|---|---|---|---|
| 96831 | 11/1922 | Fed. Rep. of Germany | 285/43 |

*Primary Examiner*—Henry J. Recla
*Assistant Examiner*—Gregory M. Vidovich
*Attorney, Agent, or Firm*—Harris Beach & Wilcox

[57] ABSTRACT

An adjustable decorative base trim plate serves as a replacement foot pad for a toilet. The trim plate is positioned between the toilet and floor to provide an attractive, level cover over discrepancies in the flooring surface that can result from toilet replacement. The trim plate is in two pieces that have overlapping flange members and slide to expand and cover a variety of sizes of footprint. Optional cutouts in each piece permit the toilet flange to protrude through. Arcuate lines can be provided to suggest trim lines that can be cut to reposition the flange openings The trim plate is formed of a tough, durable sheet material stiff enough to press against the floor and any caulking material and to stay flat and thick enough to support the toilet.

12 Claims, 3 Drawing Sheets

ADJUSTABLE TRIM PLATE FOR TOILET REPLACEMENT

BACKGROUND OF THE INVENTION

This invention relates to devices for attaching toilets and is, in particular, directed to a trim plate that can be situated between the floor and the base of a toilet to provide an attractive, level cover over discrepancies in the flooring surface.

A recent development in plumbing has been the development of highly efficient low-water-volume water-saver flush toilets. These are often retrofitted into existing bathrooms to replace older high-water-volume units. In fact, in many localities local governments and water authorities are encouraging this type of toilet replacement by granting incentives, such as water bill credits, for each old style toilet that is replaced with a water-saver toilet.

Unfortunately, removal of the old toilet can leave an unsightly "footprint" on the bare floor. Frequently, the flooring material does not continue under the toilet, and quite often there is damage to the flooring within the footprint. Even after repair of the floor the footprint can be unsightly and uneven. The replacement toilet often has a different footprint, frequently smaller, so that a portion of the uneven, unattractive flooring remains exposed beneath the base of the new toilet.

Also, the toilet flange position often occurs at different places relative to the base with different models of the older toilets. Consequently, the part of the old toilet footprint that remains exposed under the new toilet base may vary from one installation to another.

OBJECTS AND SUMMARY OF THE INVENTION

It is an object of this invention to provide a replacement cover pad or trim plate that can be positioned between the floor and the base of a replacement toilet to cover discrepancies in the flooring surface and to provide an attractive appearance under the toilet base.

It is another object to provide an adjustable trim pad that can be used with a wide variety of replacement toilets over a wide variety of footprint sizes and shapes.

It is a further object to provide an adjustable trim plate that is inexpensive, durable, and simple to install.

According to an aspect of this invention the toilet replacement trim plate is formed in two pieces as a front part and a back part that overlap and slidably adjust to various lengths. The trim plate can be expanded to cover the footprint and extend out under the base of the replacement toilet. The front and rear pieces each have main part and a flange. The flanges overlap and slide together. The thickness of the two flanges together approximately equal the thickness of the main parts. The center part of the flanges have an arcuate cutout that allow the toilet flange to protrude through. Arcuate guide lines are drawn on either the top or the bottom surface of the trim plate to suggest cutting lines. The installer can trim the plate pieces along these lines so that the flange opening is positioned correctly to cover the footprint. The adjustable flange opening feature allows for variable positing of the trim plate to conceal the old toilet footprint completely.

The trim plate is made of a tough and durable, yet attractive material, thick enough to resist peeling, and stiff enough to press against the floor and any caulking material and to stay flat as the floor leveling material hardens. The material should also be shear-trimmable, so it can be easily trimmed by the installer, using a scissors or hand shears.

The outside edge should be beveled and neatly finished to resist tripping and should be easy to clean.

The above and many other objects, features, and advantages of this invention will become apparent from the ensuing description of a preferred embodiment, to be read in conjunction with the accompanying Drawing.

DETAILED DESCRIPTION OF THE PREFERRED EMBODIMENT

Figure 1:
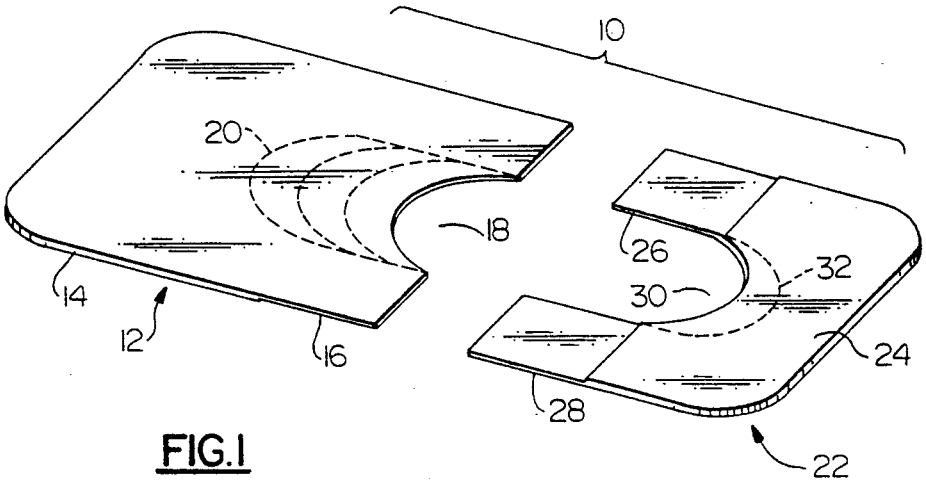
FIG. 1 is a perspective view of the trim plate of one embodiment of this invention.
Figure 2:
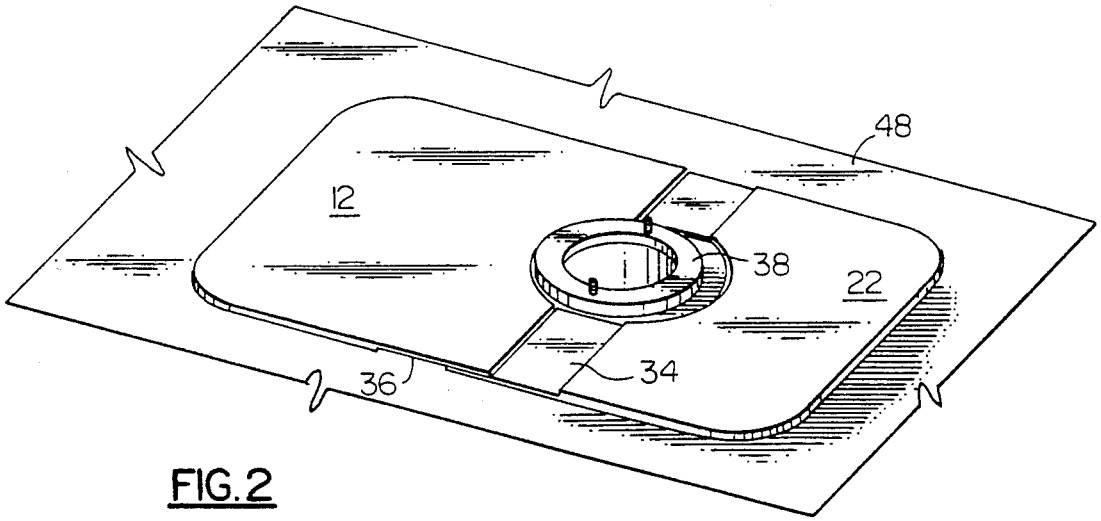
FIG. 2 is a partial assembly view showing the trim plate of this embodiment associated with a toilet flange.
Figure 3:
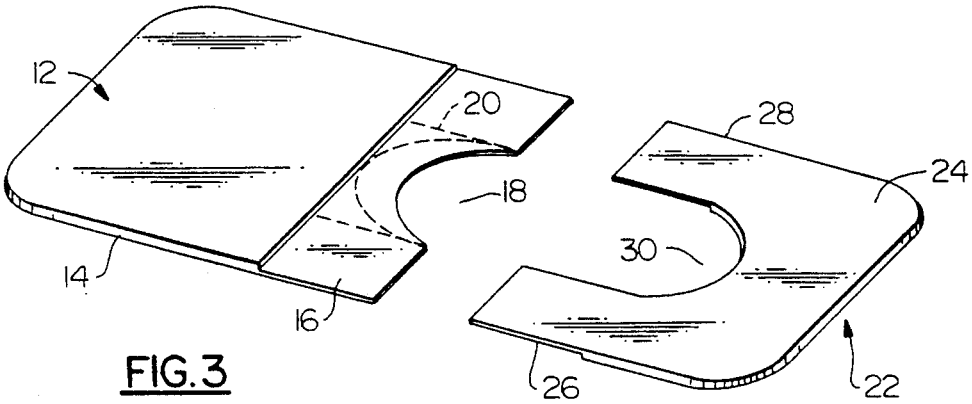
FIG. 3 is a perspective view showing the underside of this embodiment.

With reference initially to FIGS. 1, 2, and 3, an adjustable decorative trim plate 10 is constructed in two parts to adjust as to length to cover the footprint of a toilet that has been removed for replacement with a modern toilet.

The trim plate 10 has a front section 12, about eleven inches long and twelve inches wide, with a main front part 14 at its forward side and a rearwardly directed flange part 16. These dimensions are given as an example, and the trim plate could be longer, wider, etc. The flange part 16 is about one half the thickness of the main part 14 and has an upper surface that is flush with the upper surface of the main part 14. At the rear there is an arcuate cutout 18 of about seven-and-one-half inches diameter. In some embodiments the cutout or cutouts are not precut, and forming of the cutouts is left for the installer.

The trim plate is made of a thin, flexible, semi-rigid sheet material, such as polyethylene or another durable material The material is shears-trimmable, and the front section 12 is provided with arcuate guide markings 20 to facilitate enlargement of the cutout 18 so that the trim plate can accommodate the footprint of the previous toilet even if the toilet flange is not at a standard position. The markings can be on the top or the bottom, or can be omitted.

A rear section 22 of the trim plate is also about eleven inches long and about twelve inches wide. The rear section has a back main part 24 that is the same thickness as the front main part 14. A left side flange 26 and a right side flange 28 project forward from the main part 24; each of the flanges 26,28 is about one half the thickness of the main part 24.

The terms "front" and "rear" are used to help explain this embodiment, but in practice either end of the trim plate 10 could serve as front, depending on the footprint of the toilet being replaced.

These flanges have a bottom surface (FIG. 3) that is flush with the bottom surface of the back main part 24. The two flanges 26,28 define a cutout 30 between them. This cutout has an arcuate portion complementary to the other cutout 18. A guide marking 32 permits the installer to enlarge the arcuate cutout 30, if need be.

As shown in FIG. 2, the front and back portion slide together to form a flat decorative cover, disposed around a toilet flange 38 on a bathroom floor 46. The arcuate cutouts accommodate the toilet flange 38 which has a nominal diameter of about seven inches. The front and back portions 12, 22 leave small gaps 34 and 36 under new toilet edges, which can be filled with a caulk or other filling compound.

Figure 4:
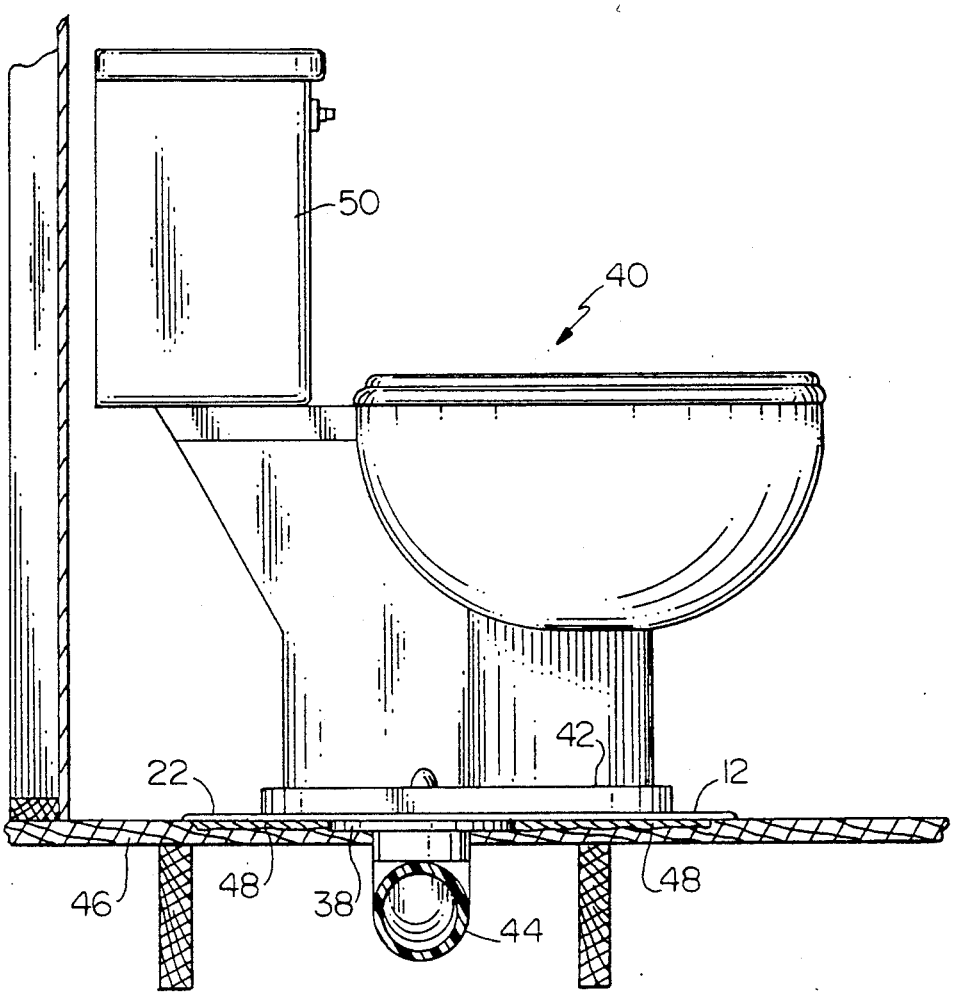
FIGS. 4, 5 and 6 are a side elevation, a front elevation, and a top plan view of a new toilet installation employing the trim plate of this invention.
Figure 6:
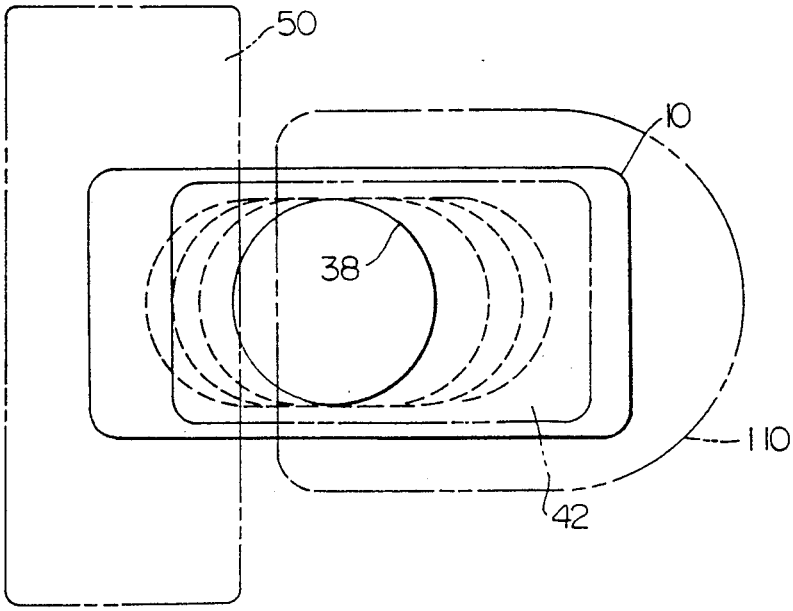
Figure 5:
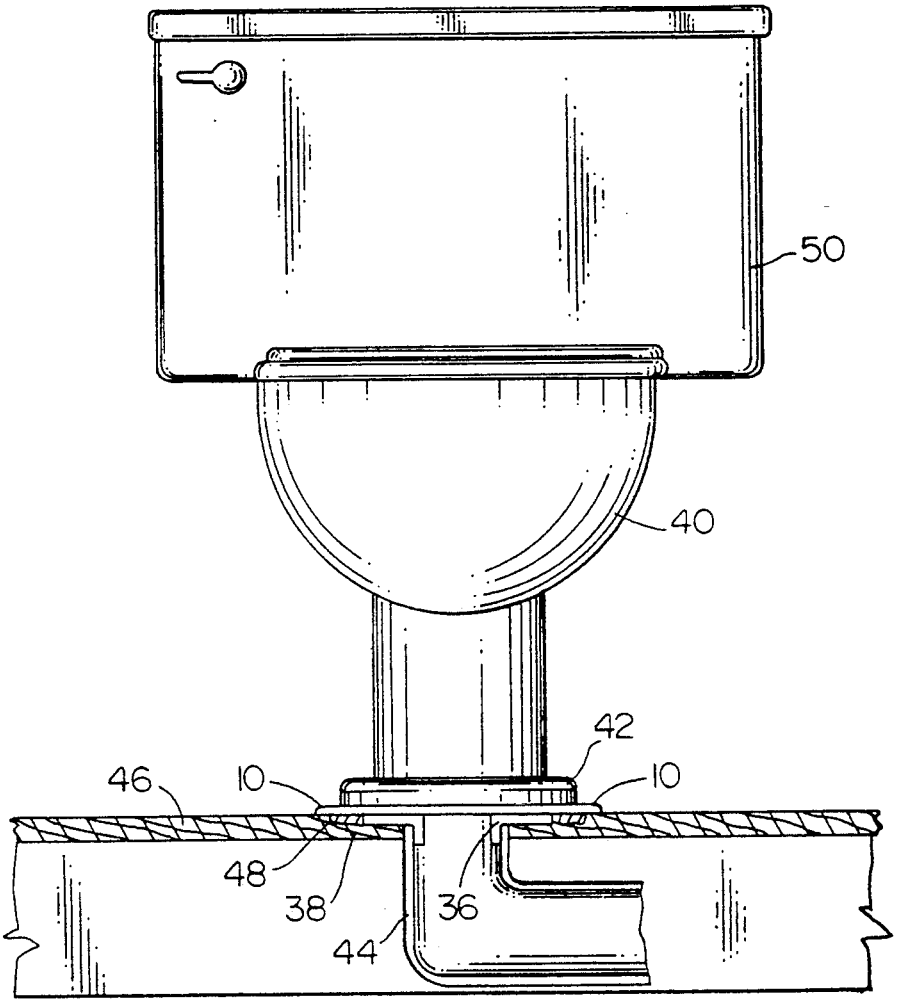

FIGS. 4, 5, and 6 show a new toilet 40 installed as a replacement on an existing toilet flange 38 in a bathroom. This toilet is preferably a small capacity flush, high efficiency toilet. The toilet has a base 42 that bolts onto studs that project upwards from the flange 38. Here the decorative trim plate 10, positioned around the flange 38, projects out from all four sides of the new toilet base or foot 42. A drain pipe 44 leads from the flange 38 and runs beneath the floor 46 to a sewer pipe (not shown).

Here, a footprint 48 of a previous toilet base is shown to be slightly longer or wider than the base 42 of the replacement toilet 40. The footprint 48 has here been filled with an epoxy or other filler material to strengthen and repair the floor 46. The trim plate 10 projects over the footprint 48 of the previous toilet and conceals it.

A toilet tank 50 is here illustrated and helps to orient the plan view of FIG. 6.

Figure 7:
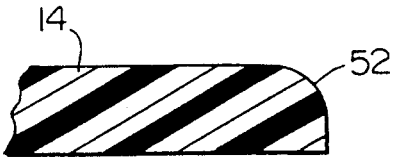
FIG. 7 is an enlarged cross section showing one edge of this embodiment of the invention.

FIG. 7 is an elongated cross section of a portion of the main part 14, showing a beveled exposed or outer edge 52. The rear main part 22 has a similar tapered edge.

The front and rear sections 12, 22 are formed of a flexible semi-rigid material that is stiff enough to resist bending after installation, but flexible enough to resist cracking. The trim plate material has enough structural stiffness to press firmly against flooring and caulking materials, while floor leveling material (e.g., shown at 48) hardens that is, with the trim plate the new toilet can be installed before the floor leveling material has hardened. The trim plate saves the cost of floor replacement. The tapered or beveled edge 52 prevents a user's shoe from catching, and also presents a crisp, smooth appearance at the exposed or visible part of the trim plate 10.

The position of the cutouts 18,30 can be adjusted, by cutting along the appropriate guide lines 20,32 to accommodate a wide variety of toilet footprints regardless of the position of the toilet flange 38. The cutouts and guide markings are shown here as circular or arcuate. However, cutouts of various non-circular shape would come within the invention, so long as they are shaped to fit over the toilet flange.

The trim pad 10 provides an attractive and level cover over discrepancies in the flooring surface resulting from toilet replacement. The trim pad 10 can be installed with a length from about sixteen to about twenty-two inches. This will match virtually all new toilets to any existing footprint. The well-finished softened or beveled edges 52 prevent dirt from collecting at the edges and make the trim plate 10 less likely to snag on cleaning devices or shoes.

While this invention has been described with reference to a preferred embodiment, it should be appreciated that the invention is not limited to that precise embodiment. Rather, many modification and variations would present themselves to those skilled in the art without departing from the scope and spirit of the invention, as defined in the appended claims.

What is claimed is:

1. An adjustable trim plate that is adapted to be positioned around an existing toilet flange and beneath a base of a toilet installed on the toilet flange, the trim plate comprising a front section and a back sect-ion that adjustably mate with one another to fit beneath the base of the toilet before the toilet is fastened in place on the toilet flange, said back section being formed of a thin sheet material of a predetermined width that extends beyond side edges of the toilet base and having a main rear portion of a first predetermined thickness and a rear flange member that projects forward therefrom having a rear cutout to accommodate a rear portion of the toilet flange, said rear flange member having a second predetermined thickness smaller than said first predetermined thickness; said front section formed of said thin sheet material of said predetermined width and having a main front portion of said first predetermined thickness and a front flange member that projects rearward from said main front portion having a front cutout therein to accommodate a front portion of the toilet flange, said front flange having a third predetermined thickness smaller than said first predetermined thickness, such that said second and third predetermined thicknesses together substantially equal said first predetermined thickness, one of said front and rear flanges having an upper surface flush with an upper surface of the respective main portion and the other of the front and rear flanges having a lower surface flush with a lower surface of its respective main portion.

2. The adjustable trim plate of claim 1 wherein said front section and said back section are of substantially the same lengths.

3. The adjustable trim plate of claim 1 wherein said front flange member and said rear flange member are of substantially equal length.

4. The adjustable trim plate of claim 1 wherein said sheet material is shears-trimmable by an installer, and said front section has arcuate guide markings thereon to permit the installer to trim the front out of the trim plate to to accommodate the front portion, of the toilet flange and to adjust to the size of an existing toilet footprint with relation to a new toilet base so that the trim plate extends beyond the new toilet base in all directions.

5. The adjustable trim plate of claim 1 wherein said rear flange member is formed of a pair of flat flange members that project forward from said main rear portion on opposite sides of said toilet flange.

6. The adjustable trim plate of claim 1 wherein the top surfaces of said front and rear main portions have outer edges which are beveled.

7. The adjustable trim plate of claim 1 wherein said rear cutout is arcuate.

8. The adjustable trim plate of claim 1 wherein said front cutout is arcuate.

9. An adjustable trim plate that is adapted to be positioned around an existing toilet flange and beneath a base of a toilet installed on the toilet flange, the trim plate comprising a front section and a back section that adjustably mate with one another to fit beneath the base of the toilet before the toilet is fastened in place on the toilet flange, the back section being formed of a thin shears-trimmable sheet material of a predetermined width that extends beyond side edges of the toilet base and having a main rear portion of a first predetermined thickness and a rear flange member that projects forward therefrom, said rear flange member having a second predetermined thickness smaller than said first predetermined thickness; said front section formed of said thin shears-trimmable sheet material of said predetermined width and having a main front portion of said first predetermined thickness and a front flange member that projects rearward from said main front portion having a third predetermined thickness such that said second and third predetermined thicknesses together substantially equal said first predetermined thickness, one of said front and rear flanges having an upper surface flush with an the upper surface of the respective portion and the other of the front and rear flange h, a lower surface flush with the lower surface of its respective main portion.

10. The adjustable trim plate of claim 9 wherein said front flange member and said rear flange member are of substantially the same widths.

11. The adjustable trim plate of claim 9 wherein one of said front and back sections has arcuate guide markings thereon to permit the installer to trim the associated flange member to form a cutout therein to match an outer edge of the toilet flange to permit the trim plate to accommodate the toilet flange and to adjust to the size of an existing toilet footprint with relation to a new toilet base so that the trim plate extends beyond the new toilet base in all directions.

12. The adjustable trim plate of claim 11 wherein said trim plate is reversible with respect to the orientation of the new toilet base.

* * * * *